United States Patent [19]

Werber

[11] 4,265,020

[45] May 5, 1981

[54] GARMENT DESIGNING AID

[76] Inventor: Fred W. K. R. Werber, 29 Schaumans-kamp, Reinbeck, Hamburg, Fed. Rep. of Germany

[21] Appl. No.: 16,573

[22] Filed: Mar. 1, 1979

Related U.S. Application Data

[62] Division of Ser. No. 853,668, Nov. 21, 1977, Pat. No. 4,156,969.

[30] Foreign Application Priority Data

Mar. 9, 1977 [ZA] South Africa ..... 77/1434

[51] Int. Cl.[3] ..... A41H 3/015

[52] U.S. Cl. ..... 33/14

[58] Field of Search ..... 33/14–17

[56] References Cited

U.S. PATENT DOCUMENTS

| | | | |
|---|---|---|---|
| 740,172 | 9/1903 | Parker et al. | 33/14 |
| 748,792 | 1/1904 | Robbert | 33/14 |
| 928,691 | 7/1909 | Peterson | 33/14 |
| 1,175,996 | 3/1916 | Rothenberger et al. | 33/14 |

*Primary Examiner*—Charles E. Phillips

*Attorney, Agent, or Firm*—Ladas & Parry

[57] ABSTRACT

The invention comprises a pants design aid which has three template panels that are slidably interconnected to cater for size variations. This aid further has a pivoted member to vary the crutch depth of the pants and two further pivoted members for varying the hip size of the pants.

9 Claims, 1 Drawing Figure

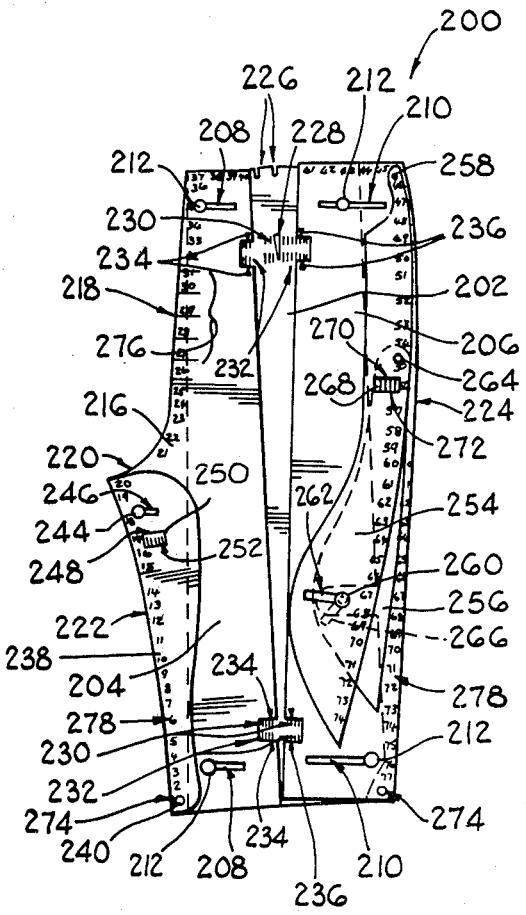
200
226
212
210
208
228
212
258
230
236
234
202
218
270
206
276
232
264
268
224
216
272
220
250
246
262
254
244
252
248
260
256
222
266
238
234
204
278
278
212
230
232
274
274
240
212
208
234
210
236

GARMENT DESIGNING AID

This is a divisional of co-pending application Ser. No. 853,668 filed Nov. 21, 1977, now U.S. Pat. No. 4,156,969 granted June 5, 1979.

This invention relates to a pattern designing aid. More particularly, the invention relates to an aid for assisting a person in designing pants.

Conventionally, women who do their own sewing and are unable to design clothing rely on purchased patterns for making dresses. These patterns come in fixed sizes predetermined by statistics and do not cater for in-between sizes and items such as differences in bust, waist, neck and arm measurements.

There is, of course, also a system by means of which small patterns may be enlarged to given sizes by a special kit. This system does not always suit all dressmakers since it calls for the drawing of the pattern from a series of dots.

Garments such as bodices, pants and skirts normally can be considered to consist of four panels which when joined together form the bodice, pants or skirt as the case may be. For example, with a bodice, when the four panels are joined together, they form the back and front of the bodice with arm-holes, a neck opening and a waist opening. It will be appreciated that the panels are in pairs—a front pair and a back pair. Each panel of a pair is a mirror image of the other panel of that pair. For a given garment, one thus need essentially a pattern for one front panel and a pattern for one back panel. Thereafter, the panels can be cut as mirror images of the ready cut panels.

According to the invention, there is provided a pants design aid for assisting a person in providing a pattern for a pair of pants, including a first template section;

a second template section which is secured to the first template section and is adjustably displaceable with respect thereto and which overlaps the first template section on one side of the first template; and a third template section which is also secured to the first template section and is adjustably displaceable with respect thereto and which overlaps the first template section on an opposite side to the second template section.

A crutch depth varying means may be provided for varying the depth of the crutch of the pants. A hip width varying means may also be provided for varying the hip dimension of the pants. Furthermore, the length of the crutch of the pants may be varied by means of a crutch length varying means. Thus, the design aid may include two pivotally displaceable members, in order to vary the hip dimension. A first member may be pivotally secured at one end to an upper outer corner portion of the third template section and a second member may be pivotally secured to the first member in the region of that part of the first member that corresponds with the hip, the two members being secured to the third member at their lower ends by means of a screw and nut, suitable slots being provided in the first and second members in which the screw is received. Similarly, the crutch depth varying means may comprise a third member pivotally secured at one end to the second template section at a bottom outer corner region thereof and which terminates at its other upper end in the region of the crutch portion of the second template section. As regards the crutch length varying means, this may be effected by providing a series of markings on that portion of the second template section which corresponds with the fly portion of the crutch, whereby in use the design aid may be displaced the required amount to increase the length of the crutch.

The first template section may have at its upper side, a waist dart position and shape indicating means, in the form of suitable notches and apertures, or by way of suitable markings on the first template section.

The pants design aid may also include a size indicating means, for indicating the extent and manner in which the second and third template sections should be displaced with respect to the first template section, in accordance with the desired size of pants. This size indicating means may conveniently be effected by providing reference markings on the second and third template sections and size gradation markings on the first template section.

The first, second and third template sections may also have design variation pointers by means of which various design features may be provided on the pattern to effect styling of the pants. These variation pointers may be in the form of numerals provided on peripheral portions of the first, second and third template sections.

The second and third template sections may conveniently be slidably displaceable with respect to the first template section.

The template sections and the first and second members of the hip adjusting means, may be of a suitable sheet material. Preferably they are of a suitable synthetic plastics material although they may also be of a cardboard or similar material.

The invention will now be described, by way of example, with reference to the accompanying drawing which shows a pants design aid in accordance with the invention.

Referring now to the drawing, shown therein is a pants designing aid 200. The pants designing aid 200 has a first template section 202, a second template section 204, and a third template section 206. The second template section 204 and the third template section 206 are slidably secured to the first template section 202 by means of bolts which are fast with the first template section 202 and which extend through slots 208 and 210 in the second and third template sections 204 and 206 respectively, the bolts being engaged by nuts 212. The second and third template sections 204 and 206 overlap different sides of the first template section 202. The side 214 of the second template section 204 which extends beyond the first template section 202 is shaped to define the crutch and inner leg seams of the pants. Thus, the second template section 204 has a side edge region 218 which defines the fly portion of the crutch seam, a portion 220 which defines the lower portion of the crutch seam, and a portion 222 which defines the inner leg seam. The outer edge 224 of the third template section 206 defines the outer leg seam of the pants. Further, the upper sides of the first, second and third template sections 202, 204 and 206 define the waist opening of the pants. Intermediate the sides of the first template section 202, and at its upper end, there are provided two notches 226 and a triangular aperture 228 which define a waist dart. Marked on the first template section 202 are two sets of size gradations. A first set 230 is utilised if the pants is to have a dart, and the other set 232 is utilised if the pants does not have a dart. In order to reference the gradations 230 and 232, pointers 234 are provided on the second template section 204 and pointers 236 are provided on the third template section 206.

The pants designing aid 200 further has a crutch depth varying member 238 which is pivotally secured at its lower end to the bottom outer corner of the second template section 204 by means of a pivot pin 240 and which varies the length of the edge portion 220 by pivotal displacement. The position of the member 238 may be adjusted by means of a bolt and nut 244 and a slot 246 in the member 238. The member 238 further has a window 248 by means of which size gradations 250 on the second template section 204 may be referenced by means of a pointer 252 on the member 238.

The hip dimension of the pants may be varied by means of two members 254 and 256. The member 254 is pivotally secured at its upper end to the upper corner of the third template section 206 by means of a pivot pin 258, the member 254 being secured in the desired pivotal position by means of a nut and bolt arrangement 260 which engages a slot 262 in the member 254. The other member 256 is pivotally secured at its upper end to the member 254, intermediate its ends, by means of a pivot pin 264. The pivot pin 264 is positioned to correspond with the hip region of the pants. The member 256 is also engaged with the nut and bolt 260 by means of a slot 266. It will be appreciated that by pivoting the member 254, the member 256 is also displaced, thereby altering the profile of the edge 224 to enlarge the hip dimension. The amount of displacement required is indicated by means of gradations 268 on the member 256 which are visible through a window 270 in the member 254 and which are referenced by means of a pointer 272.

At their lower outer corners, the second and third template sections 204 and 206 have apertures 274 by means of which a further design aid (not shown) for designing the lower leg portions of the pants, may be attached to the pants design aid 200 shown in FIG. 11.

To use the design aid 200 the second and third template sections 204 and 206 are adjusted in accordance with the required size, utilising the gradations 230 or 232 and the pointers 234 and 236. The members 238, and 254 and 256 are then adjusted if required, to provide the required crutch depth and hip size. The design aid 200 is then placed on a sheet of paper, and the outline of the upper portion of the design aid 200 drawn thereon, to provide the upper portion of the pattern. A number of gradations 276 are provided on the second template section 204 along the edge portion 218, by means of which the length of the fly portion of the crutch is varied. Thus, once the outline of the upper portion of the design aid 200 has been traced, the design aid 200 is shifted down the required amount as indicated by the gradations 276 and the rest of the outline traced to provide a pattern for the pants. If any styling variations are required, a set of numerals 278 is provided along the outer and upper sides of the second and third template sections 204 and 206. In order to make styling variations, these numerals 278 are utilised in accordance with a set of instructions, to draw various patterning lines on the pattern.

I claim:

1. A pants design aid for assisting a person in providing a pattern for a pair of pants, including a first template section;

a second template section which is secured to the first template section and is adjustably displaceable with respect thereto and which overlaps the first template section on one side of the first template;

a third template section which is also secured to the first template section and is adjustably displaceable with respect thereto and which overlaps the first template section on an opposite side to the second template section; and a hip width varying means for varying the hip dimension of the pants, said hip dimension varying means comprising two pivotally displaceable members, a first member pivotally secured at one end to an upper outer corner portion of the third template section and a second member pivotally secured to the first member in the region of that part of the first member that corresponds with the hip, the two members being secured to the third member at their lower ends by means of a screw and nut, suitable slots being provided in the first and second members.

2. A pants design aid as claimed in claim 1, which includes a crutch depth varying means for varying the depth of the crutch of the pants.

3. A pants design aid as claimed in claim 2, in which the crutch depth varying means comprises a third member pivotally secured at one end to the second template section at a bottom outer corner region thereof and which terminates at its other upper end in the region of the crutch portion of the second template section.

4. A pants design aid as claimed in claim 1, which includes a crutch length varying means for varying the length of the crutch of the pants.

5. A pants design aid as claimed in claim 4, in which the crutch length varying means comprises a series of markings on that portion of the second template section which corresponds with the fly portion of the crutch, whereby the design aid may in use be displaced the required amount to increase the length of the crutch.

6. A pants design aid as claimed in claim 1, in which the first template section has, at its upper side, a waist dart position and shape indicating means.

7. A pants design aid as claimed in claim 1, which includes a size indicating means, for indicating the extent and manner in which the second and third template sections should be displaced with respect to the first template section in accordance with the desired size of pants.

8. A pants design aid as claimed in claim 1, in which the first, second and third template sections have design variation pointers by means of which design features may be provided on the pattern.

9. A pants design aid as claimed in claim 1 in which the second and third template sections are slidably displaceable with respect to the first template section.

* * * * *